United States Patent [19]

McRae et al.

[11] 4,035,865

[45] July 19, 1977

[54] IMPLEMENTS USABLE BY PERSONS AFFLICTED WITH ARTHRITIS

[76] Inventors: Lucy Theresa McRae; Brian Joseph McRae, both of 28059 Kendallwood Road, Farmington Hills, Mich. 48024

[21] Appl. No.: 650,127

[22] Filed: Jan. 19, 1976

[51] Int. Cl.[2] ..... B25G 1/00

[52] U.S. Cl. ..... 16/114 R; 30/298; 128/77

[58] Field of Search ..... 16/110 R, 114 R; 30/340, 296, 298, 335, 327, 324, 322, 323; 128/77; 272/68

[56] References Cited

U.S. PATENT DOCUMENTS

| | | | |
|---|---|---|---|
| 705,271 | 7/1902 | Miner | 16/110 R |
| 793,309 | 6/1905 | Liebmann | 16/110 R |
| 1,409,447 | 3/1922 | Hughes | 16/110 R |
| 2,112,649 | 3/1938 | Dreyfuss | 30/296 A |
| 2,582,379 | 1/1952 | Goldberg | 16/114 R |
| 2,751,683 | 6/1956 | Johns | 30/324 |
| 2,762,120 | 9/1956 | Mack | 30/322 X |
| 3,730,523 | 5/1973 | McRae | 272/68 X |

*Primary Examiner*—Andrew V. Kundrat

[57] ABSTRACT

Implements of the hand-manipulated type are equipped with spherical handles that can be easily grasped by persons afflicted with arthritis. The spherical handle has a diameter that permits the sphere to be retained against the person's palm between the thumb and a finger without bending internal joints.

2 Claims, 10 Drawing Figures

FIG. 7
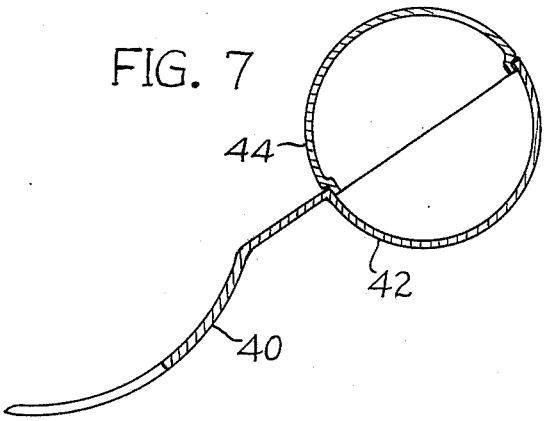
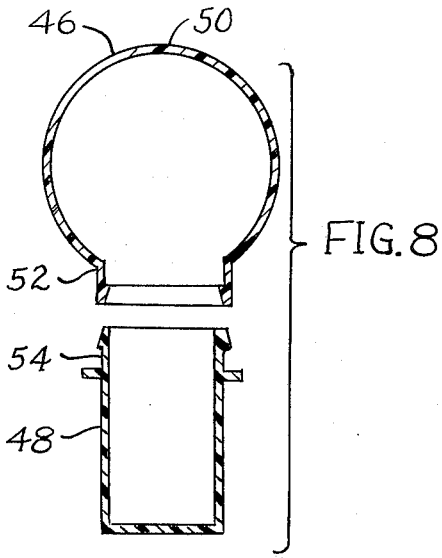
FIG. 9
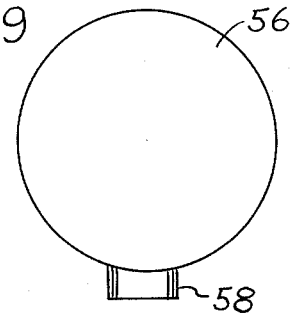
FIG. 10
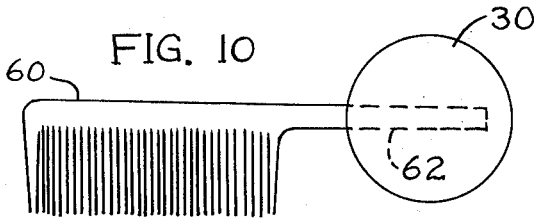

IMPLEMENTS USABLE BY PERSONS AFFLICTED WITH ARTHRITIS

BACKGROUND AND SUMMARY OF THE INVENTION

Persons afflicted with arthritis often have difficulty in moving certain joints, particularly joints in the fingers. Such persons therefore cannot easily grasp small implements such as writing pens or pencils, table knives or other cutlery, toothbrushes, combs, or medicine bottle covers. The present invention contemplates handle modification of, or addition to, such implements whereby the person afflicted with arthritis can position a thumb and finger on widely spaced surface areas of the handle without bending internal joints. An aim of the invention is to provide improved implements that a person afflected with arthritis can grasp and use effectively without excessive pain or sense of uncertainty.

THE DRAWINGS

Figure 2:
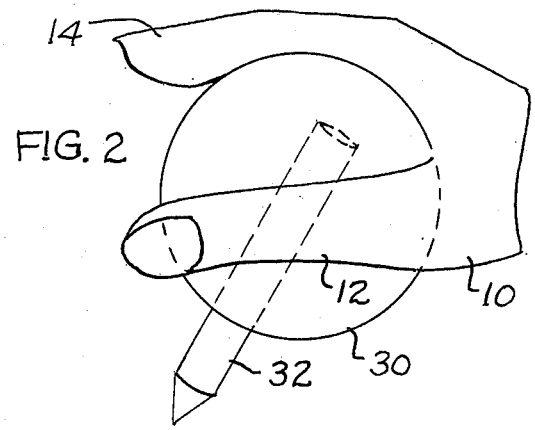
FIG. 2 shows a writing implement of this invention as it might be grasped by a user person afflicted with arthritis.
Figure 3:
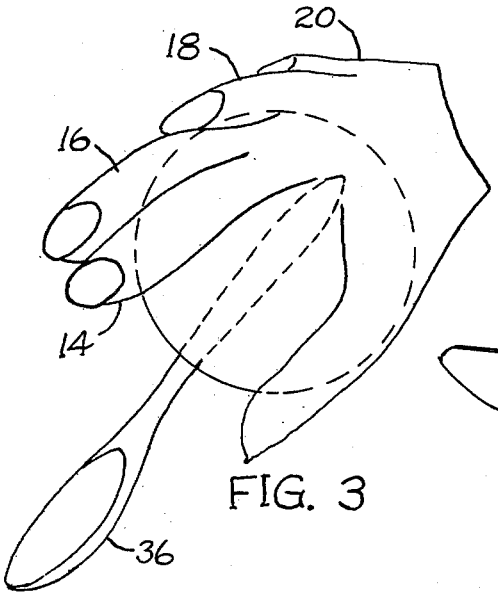
Figure 4:
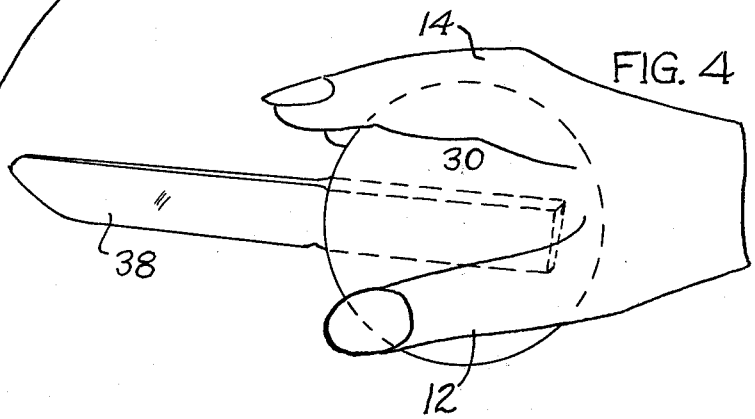
Figure 5:
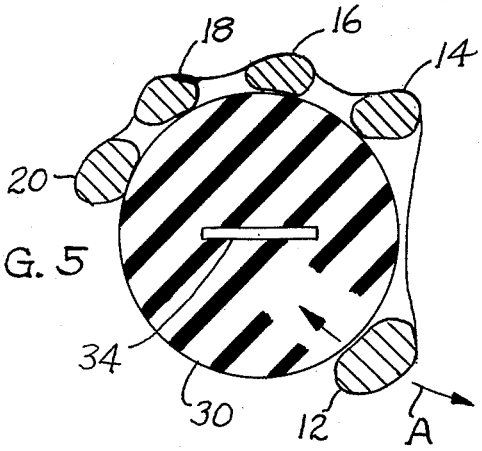
Figure 6:
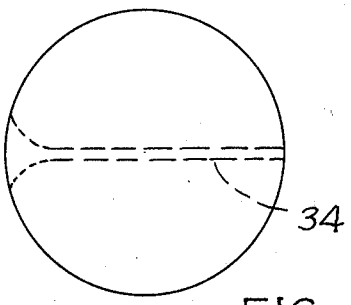

FIGS. 3 and 4 are views similar to FIG. 2, but illustrating the invention as applied to a spoon and table knife, FIGS. 5 and 6 are views of a spherical handle used in the invention assembly of FIGS. 2, 3 and 4.

FIG. 7 illustrates the invention applied to an eating fork.

FIGS. 8, 9 and 10 show a medicine bottle cover, telephone dialing aid, and comb utilizing the invention.

Figure 1:
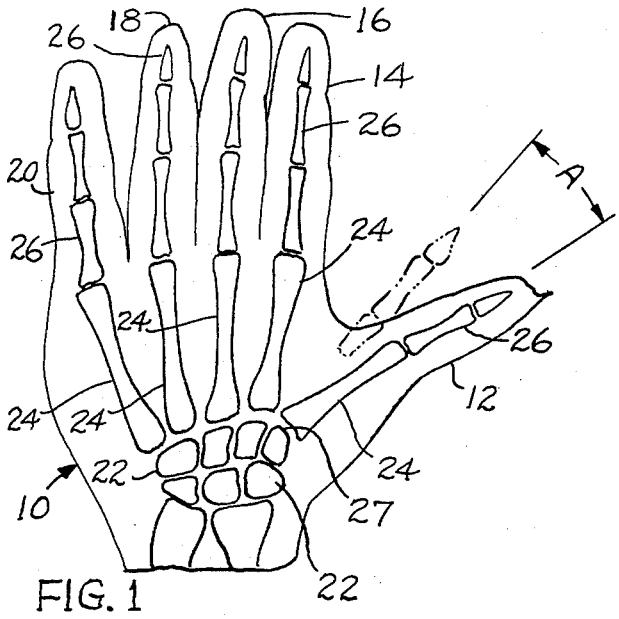
FIG. 1 is a fragmentary view of a human hand, showing internal bone structure.

FIG. 1 illustrates a human hand 10, comprising a thumb 12 and four fingers 14, 16, 18 and 20. The internal bone structure comprises a number of carpal or wrist bones 22, five metacarpal or palm bones 24, and a number of slender phalange bones 26. Each finger contains or includes three phalange bones, whereas the thumb contains only two phalanges. Muscles and tendons, not shown, run along the palm and back areas of the hand from the forearm muscles to the ends of the phalanges.

In a normally functioning hand the tendons extend or contract to hinge the phalange bones relative to one another, thereby causing the thumb and fingers to selectively straighten or bend for releasing or grasping handles or other objects. The four metacarpal bones 24 leading to the fingers remain immobile essentially during manipulative movements of the fingers; the flesh of the palm area prevents or limits sideward movement of the fingers. However the metacarpal bone 24 connected to the phalanges in thumb 12 is capable of hinging movement around its point of connection 27 with the associated carpal bone 22. The bone structure in the thumb can therefore move from the FIG. 1 full line position to the dotted line position through the arc designated by letter A. Such movement is in addition to hinging movements that can occur between the metacarpal bone and phalange bones in the thumb.

The movement designated by letter A is believed possible because of the orientation of the thumb metacarpal. As viewed in FIG. 1, the thumb metacarpal extends in front of the plane of the paper; the thumb metacarpal is therefore able to move through arc A in this imaginary "in front" plane without interference from the fingers. The thumb metacarpal can move in a generally conical orbit about connection point 27. Accordingly the thumb can move parallel to the plane of the fingers or toward any selected finger, as necessary to grasp an object within the thumb-finger space.

Arthritis adversely affects primarily the joint cartilage and tendons associated with phalanges 26. The joints at the ends of the metacarpals are not affected to as great an extent, presumably because they are in a fleshy area having relatively great blood circulation. A hand afflicted with arthritis is more or less precluded from bending movements at the fingers and thumb phalanges. It is thought that the hinging movement of the thumb metacarpal (designated by letter A) usually is largely unimpaired. The present invention recognizes the retained ability of the thumb metacarpal to move toward and away from the immobilized fingers.

FIG. 5 shows a spherical element 30 positioned between a human thumb and four fingers. If the fingers are immobilized the thumb can nevertheless move toward or away from the fingers, as denoted by direction line A, to grasp or release the spherical element. If element 30 is formed to the correct diameter the spherical surface of the element will conform approximately to the contact points of the four fingers. Also, the spherical surface will conform approximately to the concavity of the palm, i.e. the flesh area overlying the four metacarpals leading to fingers 14, 16, 18 and 20.

It is contemplated that spherical element 30 will be positioned against the palm area, and that the thumb metacarpal 24 will be moved in the direction designated by letter B to enable the person to exert gripping pressure on element 30. The present invention involves the employment of spherical element 30 as a handle for various manipulatable devices, such as writing pens or pencils, eating implements, etc. The aim is to concern ourselves with the types of implements normally used on a daily or regular basis by elderly persons that might be afflicted with arthritis.

FIG. 2 is a perspective view showing a writing instrument 32 (pen or pencil) extending through a spherical handle element 30. A user's hand 10 partially encircles the spherical element in the fashion illustrated in FIG. 5. The fingers extend rigidly outward beyond the surface of element 30, as might be the case with an arthritic hand; nevertheless the hand is able to exert retentive pressure on element 30 because the diameter of element 30 takes up the free space that would exist between the writing device and the thumb or fingers.

Preliminary experiments indicate that an optimum diameter for element 30 suited to an average adult hand is approximately one and seven eights inch. The sphere diameter can vary from a minimum value of $1\frac{1}{2}$ inches to a maximum value of about 2 inches. If the sphere diameter is less than the minimum value the sphere will not be assured of having enough contact points with the fingers 14, 16, 18, or 20; additionally the arrow A movement of thumb metacarpal 24 will be insufficient to provide thumb-palm grip on the sphere. If the sphere (positioned against the palm area) is too large, e.g. greater than about 2 inches, the sphere tends to "squirt" out of the palm cavity. Oversize or undersize hands may require special diameter spheres.

Some mechanism must be provided to rigidly secure writing device 32 to spherical element 30. As seen in FIGS. 5 and 6, the spherical element is provided with a slit-like opening 34 that extends along a radial line passing through the sphere center. In use, implement 32 is moved into the slit to a position wherein the writing tip is spaced beyond the sphere surface; slit 34 frictionally holds the writing implement in place. If the sphere is formed of a resilient elastic material the slit walls can deform to various implement shapes.

FIG. 3 illustrates spherical handle element 30 rigidly connected to a teaspoon 36. FIG. 4 illustrates the spherical handle element applied to a table knife 38. The slender shank areas on these elements 36 and 38 are extended into the slit-like socket 34 shown in FIGS. 5 and 6. The socket will accommodate different shank configurations.

FIG. 7 illustrates the invention incorporated into the functioning device. As there shown, an eating fork 40 is provided with a hollow semi-spherical extension 42 that mates with another semi-sphere 44. Solder, adhesive, etc. may be used to join the semi-spheres together.

Elderly persons afflicted with arthritis often require medication in the form of pills stored in small bottles. Conventional snap-on caps for such bottles are not easily removed or placed back on the bottle. FIG. 8 shows a functional cap 46 for a medication bottle 48. The cap comprises a spherical handle 50 and cylindrical sleeve 52 that slips on or off mouth area 54 of the bottle. The diameter of sphere 50 is sufficient to permit persons afflicted with arthritis to move the cap as desired.

FIG. 9 depicts a phone dialing aide. The FIG. shows a spherical handle element 56 that carries a cylindrical button-like protuberance 58 dimensioned to fit in the holes of the conventional telephone dialing element. The user grasps the spherical handle element and inserts protuberance 58 into the desired dial element opening.

FIG. 10 illustrates a conventional hair comb 60 having its slender shank or handle area 62 extending into the aforementioned socket in accessory handle element 30.

The examples illustrated above are belived believed show the intended mode of operation of the invention, whereby persons who have lost one or more fingers or persons afflicted with arthritis are enabled to grasp and operate spherical handles carried by or affixed to various manipulatable implements or devices.

Although not stated earlier it should be appreciated that the spherical handle element must be "operatively " oriented to the functioning device; i.e. when the handle is grasped by an arthritic hand the functioning device (pen, spoon, comb, etc.) must be located and moved in a reasonably effective fashion for the purposes intended. One advantage of a spherical handle, as opposed to other three dimentional shapes, is that a sphere can be grasped at various different points around its periphery without loss or variation in gripping pressure. Therefore, different users can place the functioning device in different orientations without loss of gripping force on the handle. For example, in the case of a pen or pencil the spherical handle permits the writing device to assume different angles or inclinations relative to the writing surface; whatever the selected inclination the user's hand can effectively control the device.

Ability of the spherical handle to be gripped at various points around its periphery may be of importance if or when a given handle is to be interchangably used with a variety of different functioning devices. For example, the spherical handle of FIGS. 5 and 6 can be used with any of the devices shown in FIGS. 2,3,4 or 10, even though such devices might be oriented slightly differently relative to the user's hand.

The functioning device may be varied as to structural detail or function without departing from the spirit of the invention. An essential feature of the invention is the use of a spherical handle element of a diameter suited to seat within the palm cavity of an average person's hand. Within the broader aspects of the invention the handle may be rigidly affixed to the functioning device, as shown in FIGS. 7,8 or 9; or the handle may be formed separately from the functioning device, as shown in FIGS. 2,3,4 and 10.

We claim:

1. A hand-manipulatable implement for use by persons afflicted with arthritis in their hands: said implement comprising a functioning device to be operated, and a handle to be held in the palm area of a person's hand:

said functioning device being selected from the class comprising an eating knife, fork, toothbrush, hair comb, writing pen, pencil, medicine bottle cover, and telephone dialing aid;

said handle being configured as a sphere having a diameter ranging between 1½ and 2 inches, whereby the sphere can be frictionally retained against the average person's palm and thumb without bending internal joints within the fingers;

the functioning device and handle being separately formed; said spherical handle having a socket opening extending inwardly from its outer surface along a sphere radius; said functioning device having a shank adapted to extend into the defined socket to form a rigid force-transmitting connection between the functioning device and handle; the sphere being formed of a resilient material, and the socket opening being a slit that can be deformed to conform to varying shank cross sections.

2. A hand-manipulatable implement for use by persons afflicted with arthritis in their hands: said implement comprising a functioning device to be operated, and a handle to be held in the palm area of a person's hand:

said functioning device being selected from the class comprising an eating knife, fork, toothbrush, hair comb, writing pen, pencil, medicine bottle cover, and telephone dialing aid;

said handle being configured as a sphere having a diameter ranging between 1½ and 2 inches, whereby the sphere can be frictionally retained against the average person's palm and thumb without bending internal joints within the fingers;

the spherical handle comprising two semi-spheres, one of the semi-spheres being integral with the functioning device.

* * * * *